US006026930A

United States Patent [19]

Ogisu et al.

[11] Patent Number: 6,026,930

[45] Date of Patent: Feb. 22, 2000

[54] EXHAUST APPARATUS OF VEHICLES

[75] Inventors: Noriyuki Ogisu; Tadashi Sugano; Kazuya Shindome, all of Saitama, Japan

[73] Assignee: Honda Giken Kogyo Kabushiki Kaisha, Tokyo, Japan

[21] Appl. No.: 09/254,659

[22] PCT Filed: Oct. 31, 1997

[86] PCT No.: PCT/JP97/03975

§ 371 Date: May 17, 1999

§ 102(e) Date: May 17, 1999

[87] PCT Pub. No.: WO98/19056

PCT Pub. Date: May 7, 1998

[30] Foreign Application Priority Data

Oct. 31, 1996 [JP] Japan ..... 8-290816

[51] Int. Cl.[7] ..... F01N 7/08

[52] U.S. Cl. ..... 181/228; 181/227; 181/272

[58] Field of Search ..... 181/227, 228, 181/240, 256, 269, 272, 282; 180/89.2, 219, 226, 228, 296

[56] References Cited

U.S. PATENT DOCUMENTS

| | | | |
|---|---|---|---|
| Re. 31,989 | 9/1985 | Nomura et al. | 181/228 |
| 3,949,829 | 4/1976 | Honda et al. | 181/228 |

FOREIGN PATENT DOCUMENTS

| | | |
|---|---|---|
| 51-93015 | 7/1976 | Japan . |
| 59-93917 | 5/1984 | Japan . |
| 63-134809 | 6/1988 | Japan . |
| 2-241920 | 9/1990 | Japan . |
| 828258 | 1/1996 | Japan . |

OTHER PUBLICATIONS

Abstract for Japanese Patent Publication 02–241920 (A), Sep. 1990.

Abstract for Japanese Patent Publication 08–028258 (A), Jan. 1996.

Abstract for Japanese Patent Publication 51–093015 (U), Jul. 1976.

Abstract for Japanese Patent Publication 59–093917 (A), Jun. 1988.

Abstract for Japanese Patent Publication 63–134809 (A), May 1984.

*Primary Examiner*—Khanh Dang

*Attorney, Agent, or Firm*—Birch, Stewart, Kolasch & Birch, LLP

[57] ABSTRACT

A first muffler (4) is connected to a rear end portion of the exhaust pipe (2) extending from a single-cylinder engine toward one side of a rear portion of the vehicle body and is provided on one side of the vehicle body. A second muffler (5) is provided on the other side of the vehicle body opposite to the first muffler (4) through a connecting pipe (6). An outer side surface near the front end portion of the first muffler (4) and the second muffler (5) are covered with first and second covers (7) and (8) both plated. Each of the exhaust pipe (2) and the first and second mufflers (4) and (5) have double-pipe structure with outside plated. Further, a front end portion of the second cover (8) is curved toward the center of the vehicle body, and a phantom line as a continuous frontward extension from the front end portion of the second cover (8) is positioned before the axis of the connecting pipe (6).

2 Claims, 13 Drawing Sheets

EXHAUST APPARATUS OF VEHICLES

This application is the national phase under 35 U.S.C. §371 of prior PCT International Application No. PCT/JP97/03975 which has an International filing date of Oct. 31, 1997 which designated the United States of America.

FIELD OF THE INVENTION

The present invention relates to an exhaust device having a pair of mufflers on the right and left sides of a vehicle body in a vehicle such as a motorcycle on which a single-cylinder engine is mounted.

DESCRIPTION OF THE PRIOR ART

Japanese Patent Laid-open No. 2-241920 discloses an exhaust device having a pair of mufflers on the right and left sides of a vehicle body in a motorcycle on which a single-cylinder engine is mounted.

This exhaust device includes an exhaust pipe extending from the single-cylinder engine toward one side of a rear portion of the vehicle body, a first muffler connected to a rear end portion of the exhaust pipe and provided on one sides of the vehicle body, a second muffler provided on the other side of the vehicle body opposite to the first muffler, and a connecting pipe for connecting a front end portion of the second muffler and a front end portion of the first muffler so as to extend laterally of the vehicle body.

While the surface of an outward appearing portion of the exhaust device is required to be plated, such a plated portion is possibly discolored by exhaust heat. To prevent such discoloration, each of the exhaust pipe, the connecting pipe, and the first and second mufflers must be formed to have a double-pipe structure, and the outer surface of each component must be plated.

However, the connection between these double-pipe structural components is complicated in structure, and much time is required for manufacturing. Further, if the connecting portion is formed to have a single-pipe structure, the plated surface of the exhaust device as a whole becomes discontinuous, and partial discoloration occurs, so that it is difficult to maintain the appearance of the exhaust pipe good.

It is accordingly an object of the present invention to provide an exhaust device for use with a single-cylinder engine in which a pair of mufflers can be provided on the opposite sides of a vehicle body without damage to the appearance, and a good look can be maintained with easy manufacturing.

DISCLOSURE OF THE INVENTION

FIG. 1 shows the principle of the present invention. As shown in FIG. 1, the exhaust device for vehicle according to the present invention includes a single-cylinder engine 1, an exhaust pipe 2 extending from the single-cylinder engine 1 toward one side of a rear portion of a vehicle body, a branch and joint member 3 connected to a rear end portion of the exhaust pipe 2, a first muffler 4 connected to a rear end portion of the branch and joint member 3 and provided on one side of the vehicle body, a second muffler 5 provided on the other side of the vehicle body opposite to the first muffler 4, a connecting pipe 6 connecting a front end portion of the second muffler 5 and the branch and joint member 3 and extending laterally of the vehicle body, a first cover 7 for covering an outer side surface of the branch and joint members 3, and a second cover 8 for covering an outer side surface of a connecting portion between a front portion of the second muffler 5 and the connecting pipe 6.

Each of the exhaust pipe 2, the first muffler 4, and the second muffler 5 has a double-pipe structure with outside plating. Each of the branch and joint member 3 and the connecting pipe 6 has a single-pipe structure. Each of the first and second covers 7 and 8 is plated.

Preferably, a front end portion of the second cover 8 is curved toward the center of the vehicle body, and a phantom line as a continuous frontward extension from the front end portion of the second cover 8 is positioned before the axis of the connecting pipe.

The rear end portion of the exhaust pipe 2 having a double-pipe structure and the front end portion of the first and second mufflers 4 and 5 both having a double-pipe structure are connected together through the branch and joint member 3 and the connecting pipe 6 both having a single-pipe structure. Accordingly, the connection structure of each connecting component can be simplified and the exhaust device can be easily manufactured.

Further, the outer side surface of these single-pipe structural components 3 and 6 that are prone to discoloration due to exhaust heat are covered with the first and second covers 7 and 8 both plated, that is, concealed from side view. Further, the first and second covers 7 and 8 are continuous in appearance to the mufflers. Accordingly, the first and second covers 7 and 8 readily look like continuous portions of exhaust device rather than mere separate covers that may look as if they are raised from their surrounding parts. Thus, the appearance of the exhaust device as a whole can be made into a condition such that it is substantially uniformly plated without any discoloration due to exhaust heat.

Although the single-cylinder engine 1 is mounted on the vehicle, the pair of mufflers 4 and 5 can be provided on the opposite sides of the vehicle body without damage to the appearance, and it is possible to obtain an exhaust device having a good look as a whole and easy to manufacture.

Further, in the case that the front end portion of the second cover 8 is curved toward the center of the vehicle body, and the phantom line continuously extending frontward from the front end portion of the second cover 8 is positioned before the axis of the connecting pipe 6, the second muffler 5 looks as if it is directly connected through the second cover 8 to a virtual exhaust pipe 9 shown in FIG. 1. Furthermore, the presence itself of the second cover 8 is not so visually felt, thereby providing natural feeling to the exhaust device as a whole and further improving the appearance.

DESCRIPTION OF THE PREFERRED EMBODIMENTS

Figure 1:
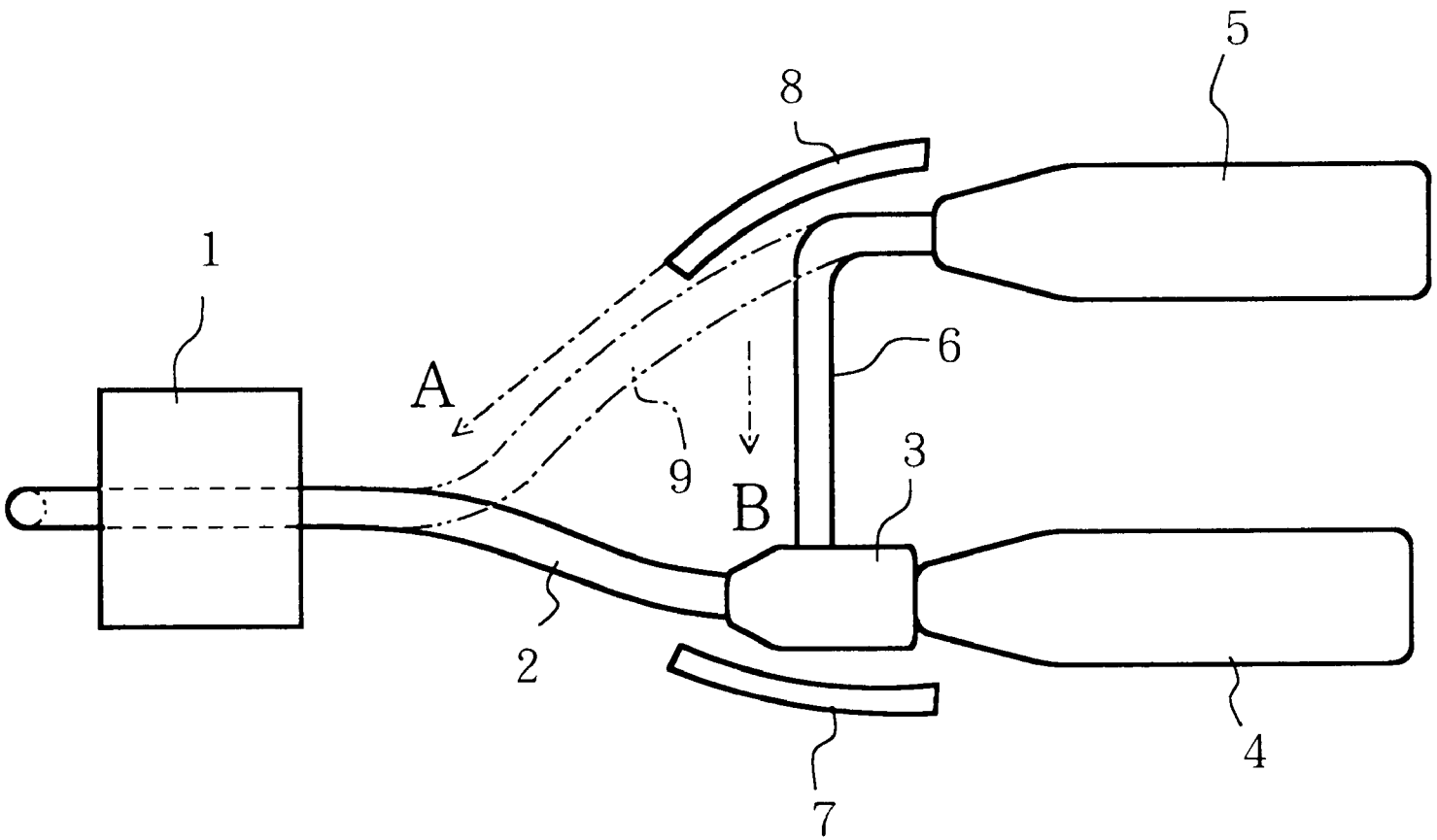
FIG. 1 is a top plan view illustrating the principle of the present invention.

Referring to FIG. 2 to 5, an embodiment according to the present invention is explained. Hereafter, the same reference numeral is used for such a common functional part as shown in FIG. 1. The motorcycle includes a single-cylinder engine 1 supported by a body frame 12 between a front wheel 10 and a rear wheel 11. An exhaust pipe 2 connected at one end thereof to the engine 1 extends rearward along the lower side of the engine 1 toward the left side of the vehicle body. The other end of the exhaust pipe 2 is connected through a branch and joint member 3 to a first muffler 4 extending along the left side of the rear wheel 11.

A second muffler 5 is provided on the right side of the vehicle body so as to extend along the right side of the rear wheel 11. A front end portion of the second muffler 5 is connected to the branch and joint member 3 by means of a connecting pipe 6 extending laterally of the vehicle body. An outer side surface of the branch and joint member 3 is covered with a first cover 7 so as to be externally invisible from the left side of the vehicle body. Similarly, an outer side surface of a connecting portion between a front portion of the second muffler 5 and the connecting pipe 6 is covered with a second cover 8 so as to be externally invisible from the right side of the vehicle body.

A front fork 13 supporting the front wheel 10 is pivotably supported to a head pipe 14, and is steered by handlebars 15. Reference numeral 16 denotes a handgrip, and reference numeral 17 denotes a steering lock.

The front wheel 10 includes a spoke wheel 18 formed of a light alloy or the like. A brake disc 19 is provided on one side of the spoke wheel 18, and is braked by a brake caliper 20. Reference numeral 21 denotes a front fender.

An upper portion of a cylinder portion 22 of the engine 1 is covered with a front side cover 23. A carburetor 24 is provided behind the cylinder portion 22. A self-starting motor 26 is provided at an upper portion of a crankcase 25 located beneath the cylinder portion 22.

A gearshift pedal 27 is provided at a lower front portion of the crankcase 25 on the left side of the vehicle body, and a brake pedal 28 is provided at the same portion on the right side of the vehicle body.

The body frame 12 is of a cradle type including a main frame 12*a* extending longitudinally of the vehicle body at an upper position thereof, a pair of right and left front down frames 12*b* extending downward and rearward from the head pipe 14, a pair of right and left lower frames 12*c* extending substantially horizontally rearward from the lower ends of the right and left front down frames 12*b* and supporting a lower portion of the crankcase 25, a pair of right and left rear stays 12*d* extending upward and rearward from the rear ends of the right and left lower frames 12*c*, and a pair of right and left center down frames 12*e* extending downward and rearward from the rear end of the main frame 12*a*.

A pair of right and left footrests 29 for a rider are mounted on the right and left lower frames 12*c* at their respective front portions. A side stand 30 is pivotably supported to the left lower frame 12*c* at a position behind the left footrest 29.

A pair of right and left pivot plates 31 are supported to the right and left rear stays 12*d* and the right and left center down frames 12*c* at their respective lower end portions. Each pivot plate 31 is provided with a pivot portion 32 for pivotably supporting a front end portion of a rear swing arm 33. A pair of right and left footrests 34 for a passenger are mounted on the right and left rear stays 12*d*.

A fuel tank 35 is supported on the main frame 12*a* above the cylinder portion 22. A rider's seat 36 and a passenger's seat 37 are provided in tandem behind the fuel tank 35. The passenger's seat 37 is supported on a rear fender body portion 38.

A rear fender tail portion 39 extends downward and rearward from the rear end of the rear fender body portion 38. A pair of right and left grab rails 40 are provided on the right and left side surfaces of the rear fender body portion 38 so as to extend rearward from the driver's seat 36.

A vertically extending backrest stay 41 is supported at its right and left lower ends to the rear portions of the right and left grab rails 40. A backrest 42 is supported to the backrest stay 41 at its upper portion.

Figure 2:
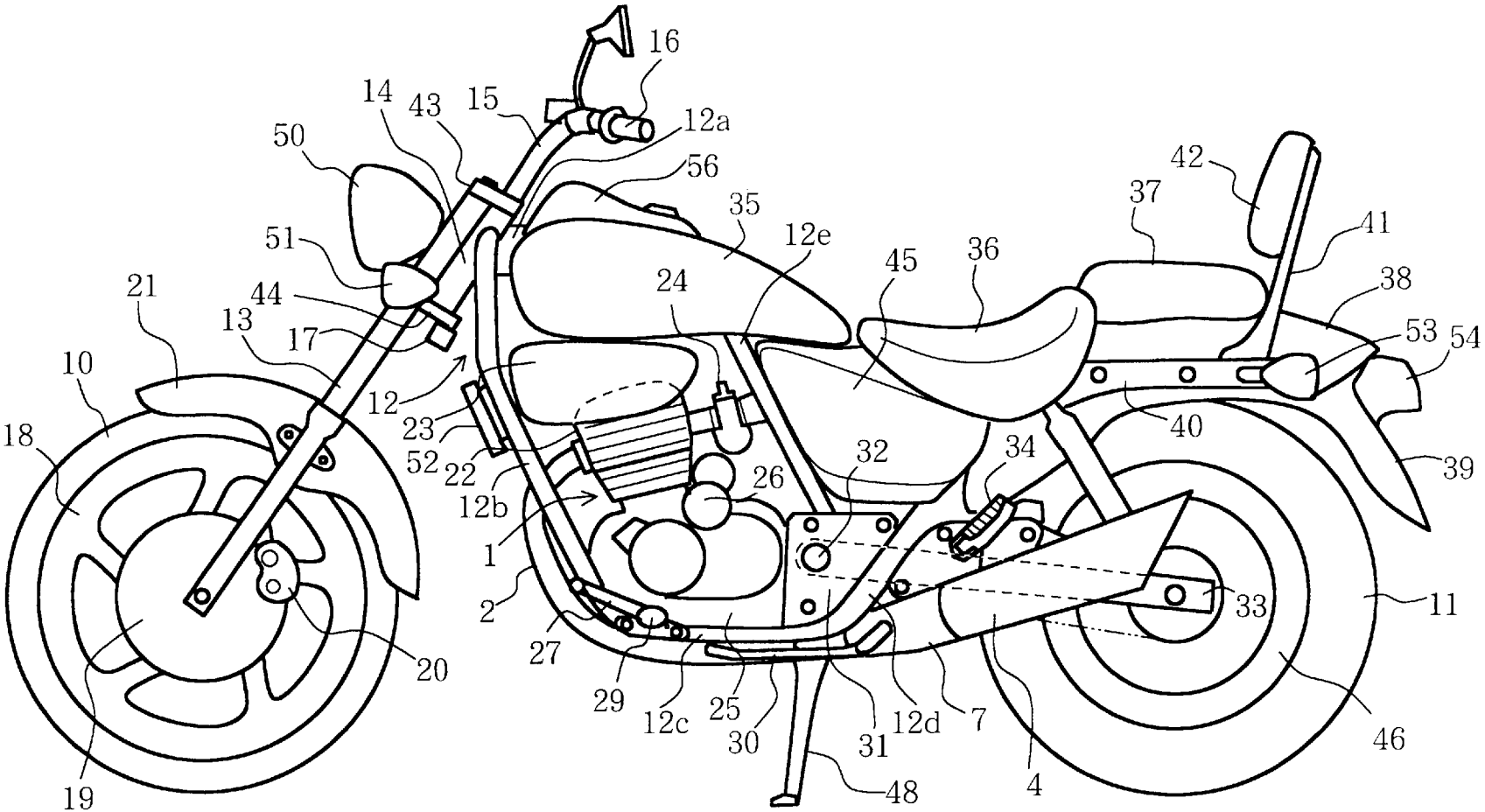
FIG. 2 is a left side view showing the appearance of a vehicle body of a motorcycle to which the present invention is applied.
Figure 3:
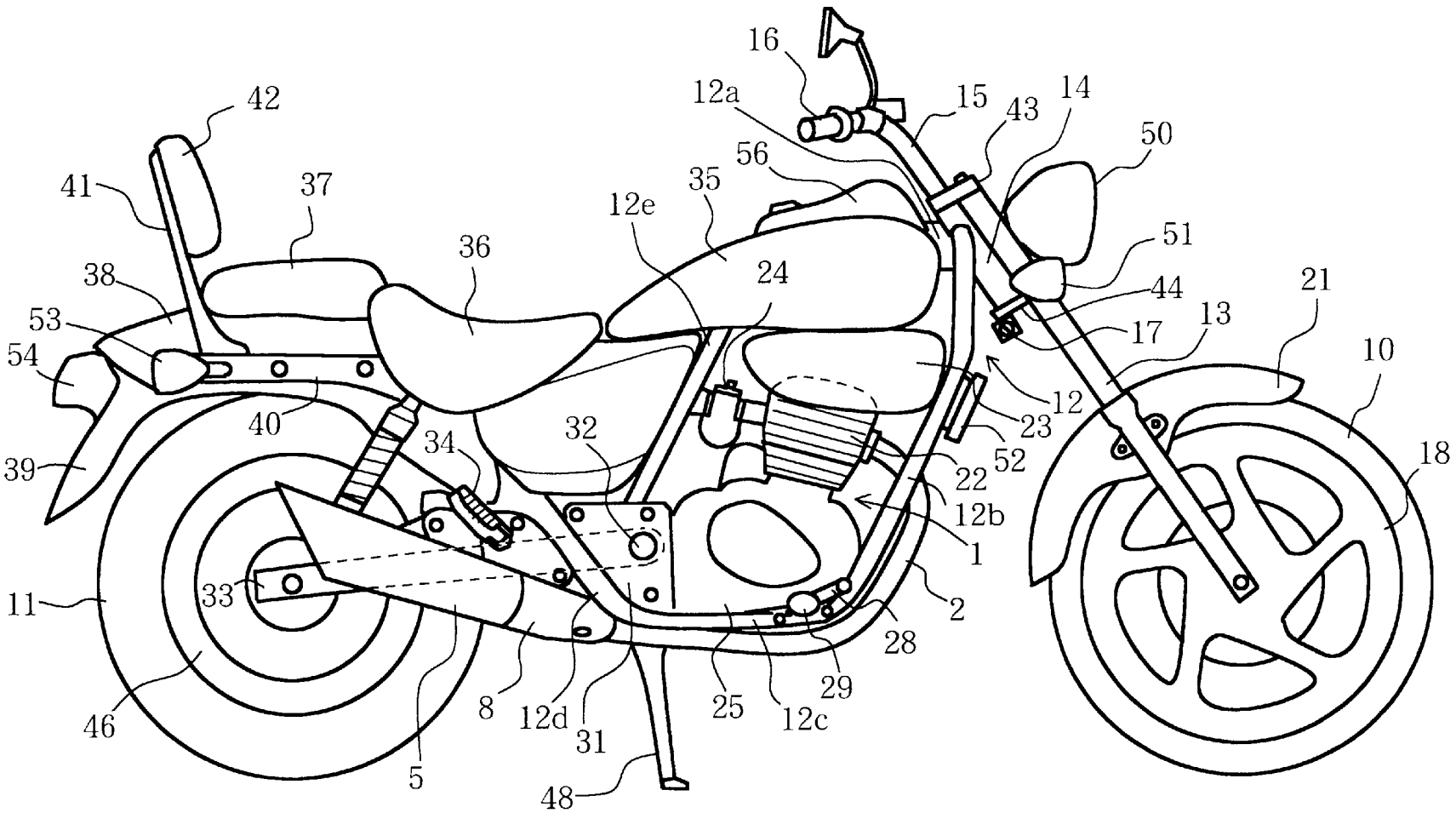
FIG. 3 is a right side view of the motorcycle.

In FIGS. 2 and 3, reference numeral 43 denotes a top bridge, 44 a bottom bridge, 45 a side cover, and 46 a substantially disk-shaped dish wheel.

Figure 5:
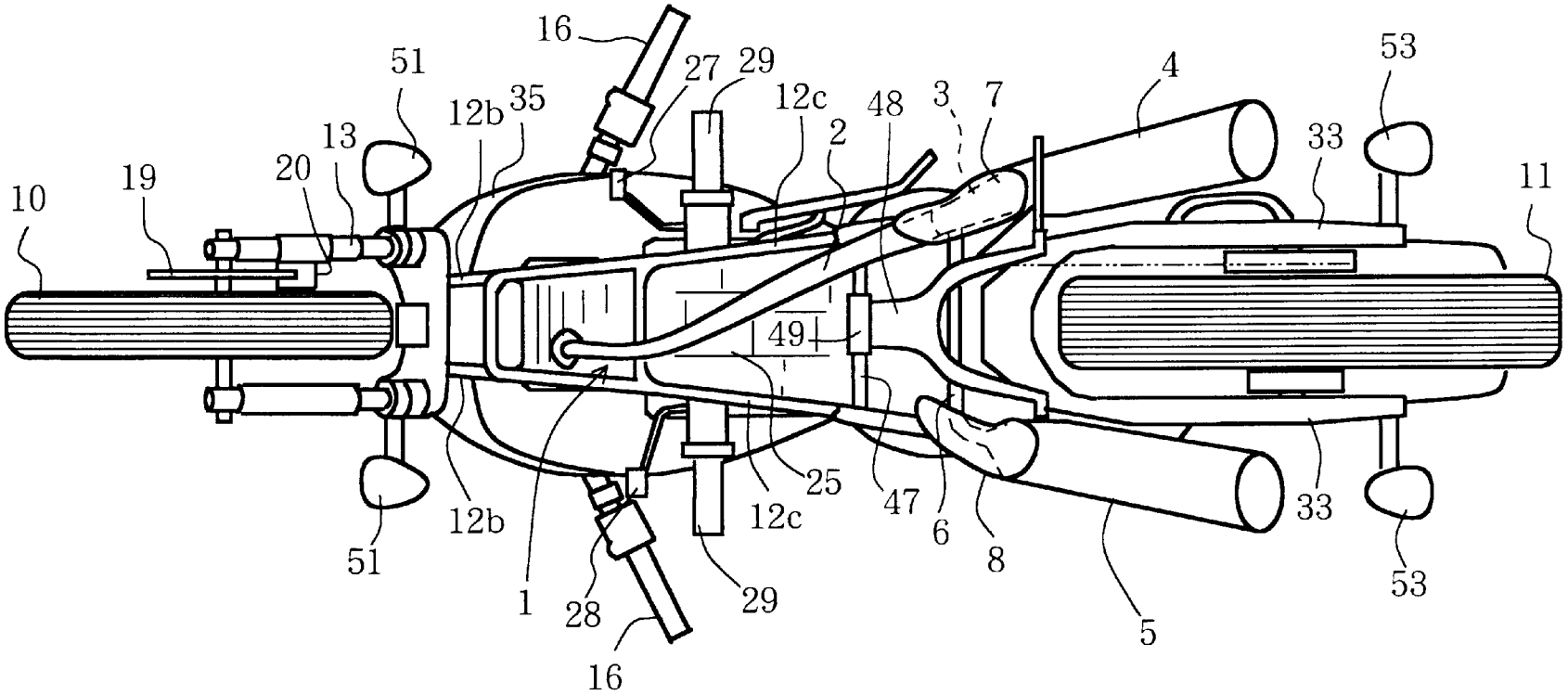
FIG. 5 is a bottom plan view of the motorcycle.

As apparent from FIG. 5, a cross pipe 47 is provided between the right and left lower frames 12*c* in the vicinity of a bottom rear position of the crankcase 25. A pivot portion 29 of a main stand 48 is pivotably supported to the cross pipe 47.

The pivot portion 49 is located before the connecting pipe 6, and the main stand 48 in its retracted condition is located below the connecting pipe 6. Accordingly, the connecting pipe 6 is covered on its front and lower side with the main stand 48 during running of the vehicle, thereby being protected against a bouncing stone coming from the front wheel 10.

Electrical components mounted on the motorcycle include a headlight 50, front turn signals 51, horn 52, rear turn signals 53, and taillight 54.

Figure 4:
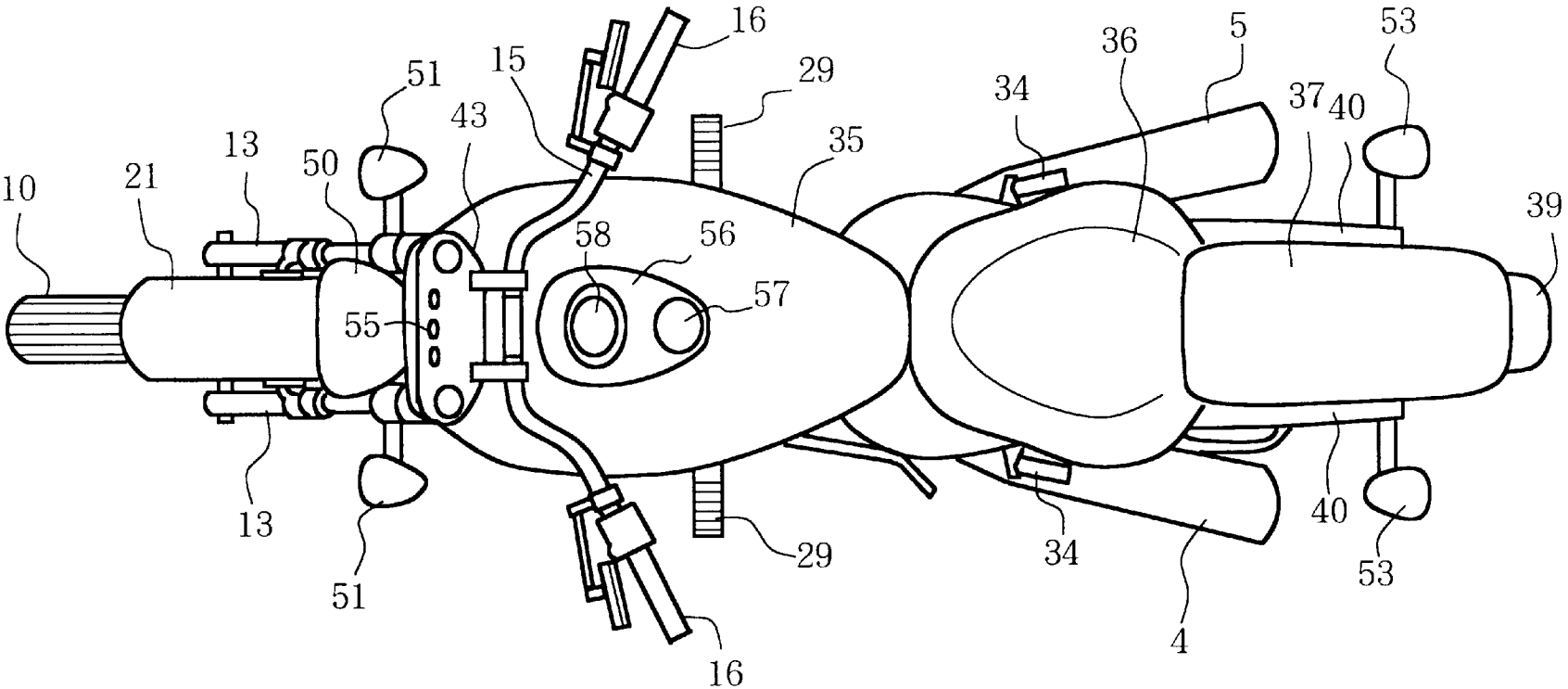
FIG. 4 is a top plan view of the motorcycle.

As apparent from FIG. 4, various indicators 55 are provided on the top bridge 43. A projecting portion 56 is formed on the upper surface of the fuel tank 35, and a meter 58 is provided on the projecting portion 56 at a position before a fuel filler opening 57.

The structure of the exhaust device will now be described in detail with reference to FIGS. 6 to 14. Although not shown, the exhaust pipe 2 has a double-pipe structure and is generally plated. A nut portion 60 is provided on the outer side surface of the exhaust pipe 2 at its rear end portion.

Figure 8:
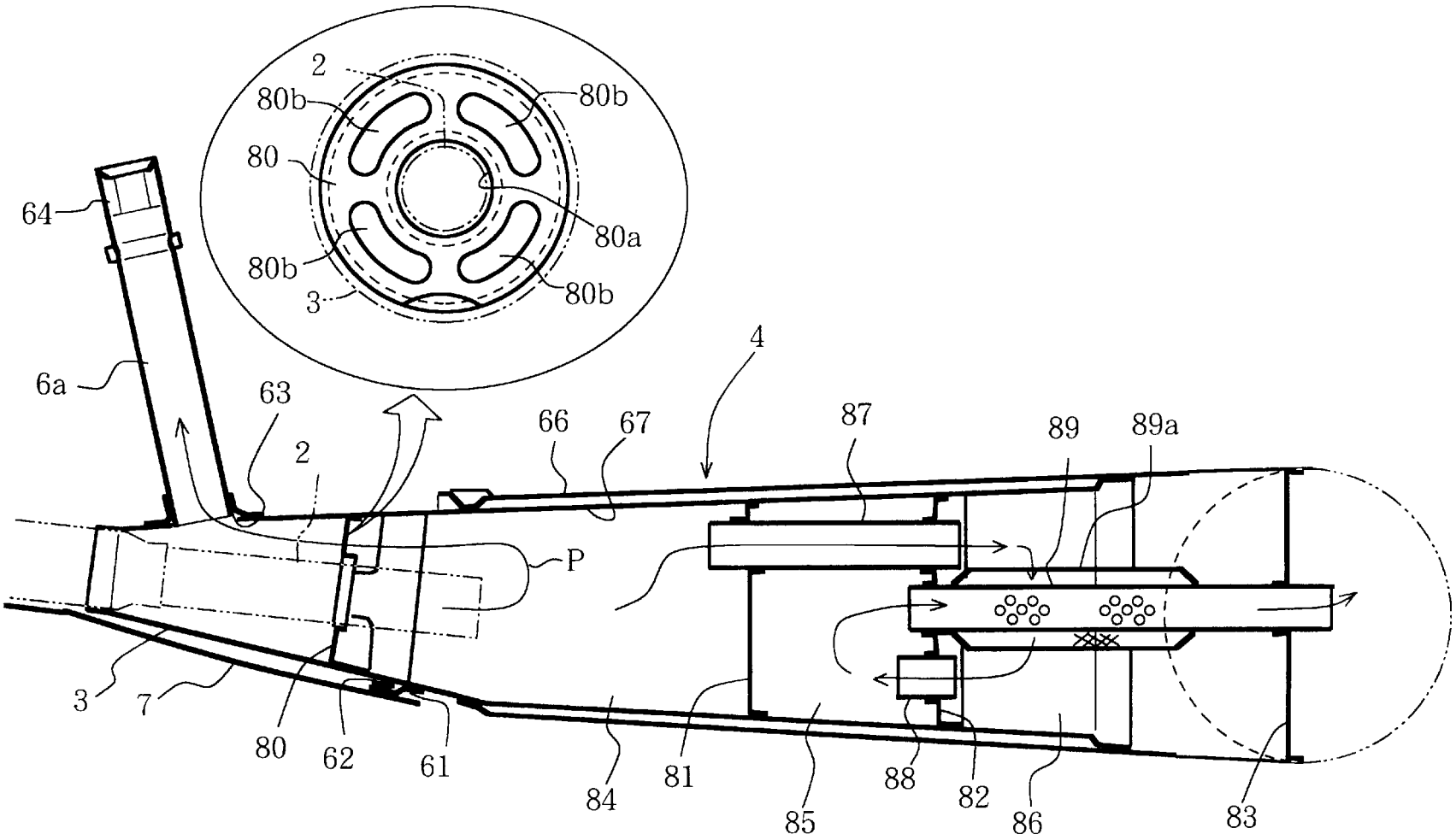
FIG. 8 is a horizontal sectional view of the left-hand part with an exhaust pipe being not shown.
Figure 9:
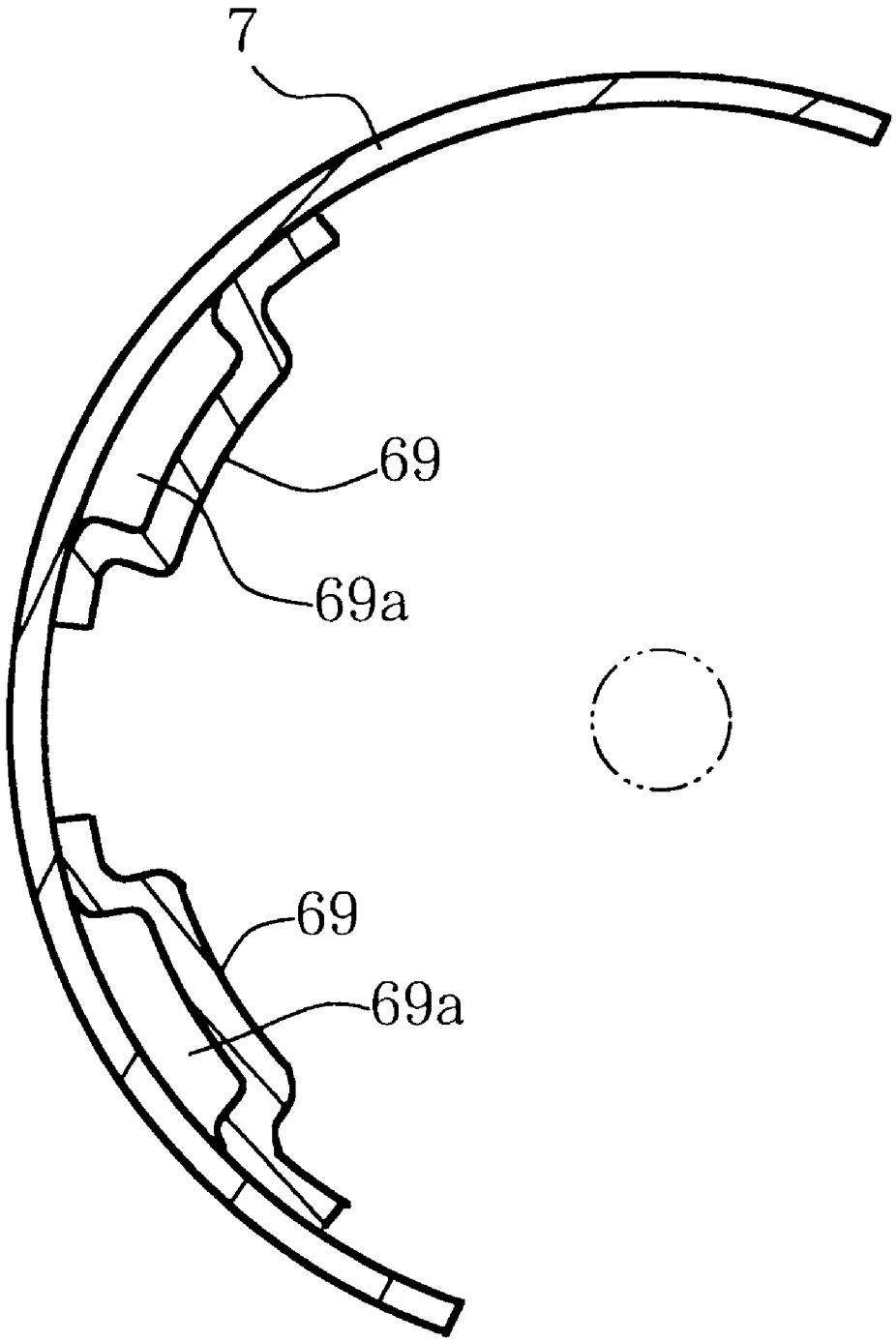
FIG. 9 is an enlarged cross section taken along the line 9—9 in FIG. 7.

As apparent from FIG. 8, the branch and joint member 3 has a single-pipe structure, and it is integrated with the front end of the first muffler 4 by welding. A bracket 61 is mounted on the outer side surface of the branch and joint member 3. The bracket 61 is formed with two hooks 62 raised from the outer side surface of the branch and joint member 3.

The inner side surface of the branch and joint member 3 is formed with a side connection opening 63, and a left connecting pipe member 6*a* is connected with the side connection opening 63. The left connecting pipe member 6*a* has a connection end portion 64 adapted to engage a joint 65 (see FIG. 10) of a right connecting pipe member 6*b*.

That is, the connecting pipe 6 can be divided at its intermediate portion into the right and left connecting pipe members 6*a* and 6*b*, and has a single-pipe structure as a whole.

The first muffler 4 has a double-pipe structure composed of an outer wall 66 and an inner wall 67, and the internal structure of the first muffler 4 is similar to that of a known muffler such that the inside space is separated into a plurality of chambers. The outer surface of the outer wall 66 is generally plated.

Figure 6:
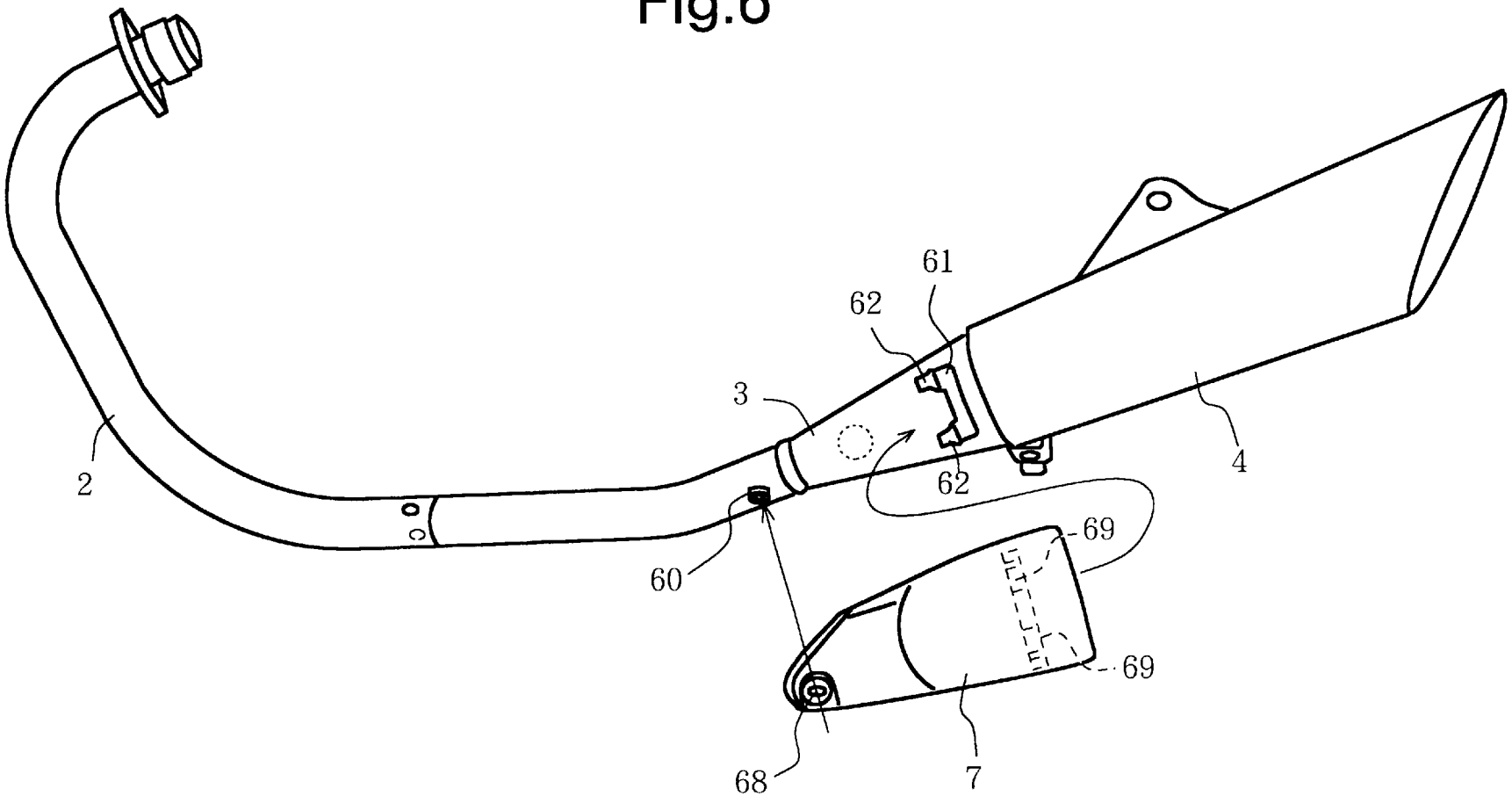
FIG. 6 is a left side view of a left-hand part of an exhaust device with a first cover being separated.
Figure 7:
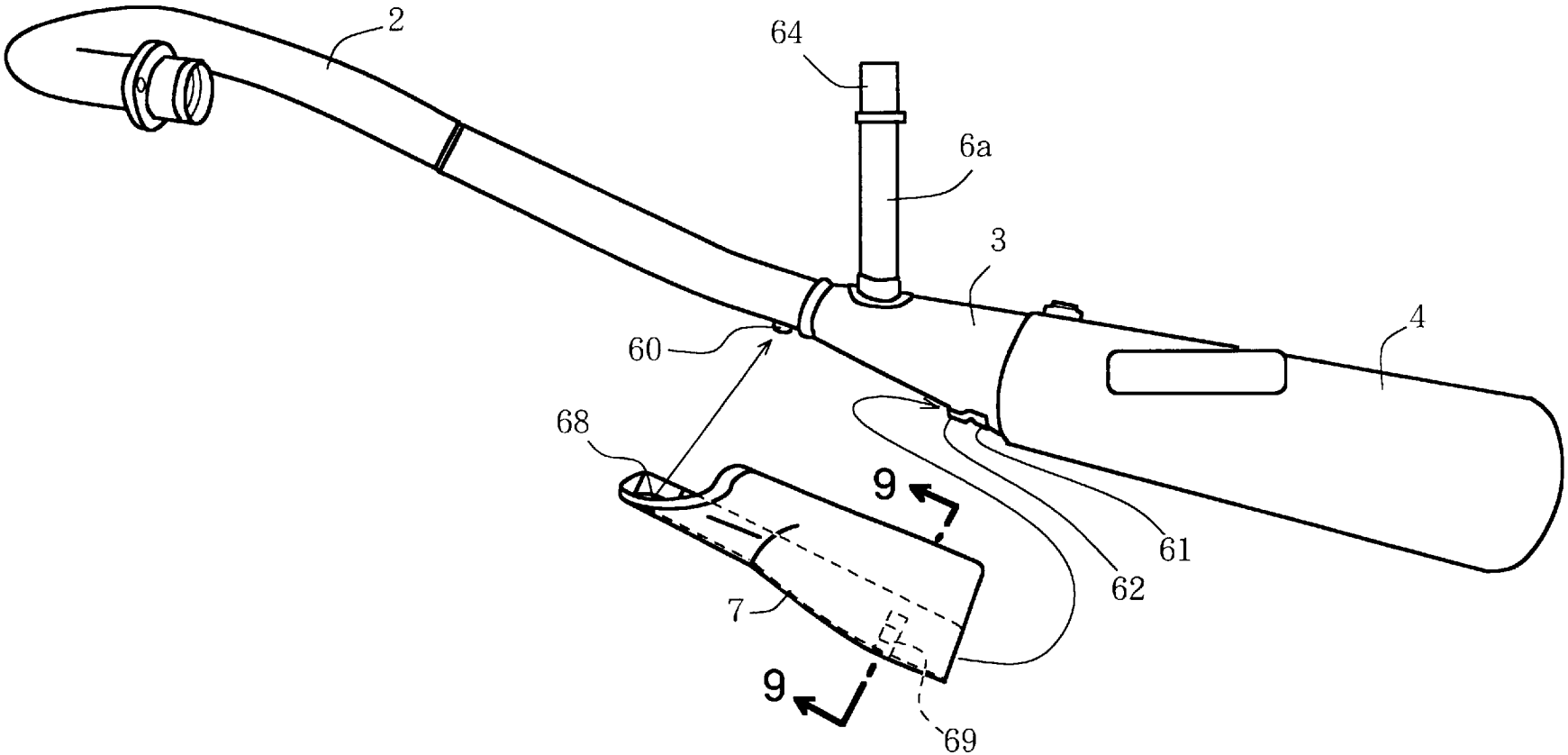
FIG. 7 is a top plan view of the left-hand part.

As apparent from FIGS. 6 and 7, the first cover 7 is formed from a suitable material such as an iron plate. The first cover 7 has a substantially triangular shape as viewed in side elevation so as to be fitted with the outer side surface of the branch and joint member 3. Further, as apparent from FIG. 9, the cross section of the first cover 7 along a direction perpendicular to the longitudinal direction of the first cover 7 is substantially semicircular. The outer surface of the first cover 7 is also generally plated.

A through hole 68 is formed at a front end portion of the first cover 7. As apparent from FIG. 9, two stays 69 are mounted on the inner surface of the first cover 7 at its rear portion, so as to form two tunnel-like holes 69*a* for respectively engaging the two hooks 62.

Figure 10:
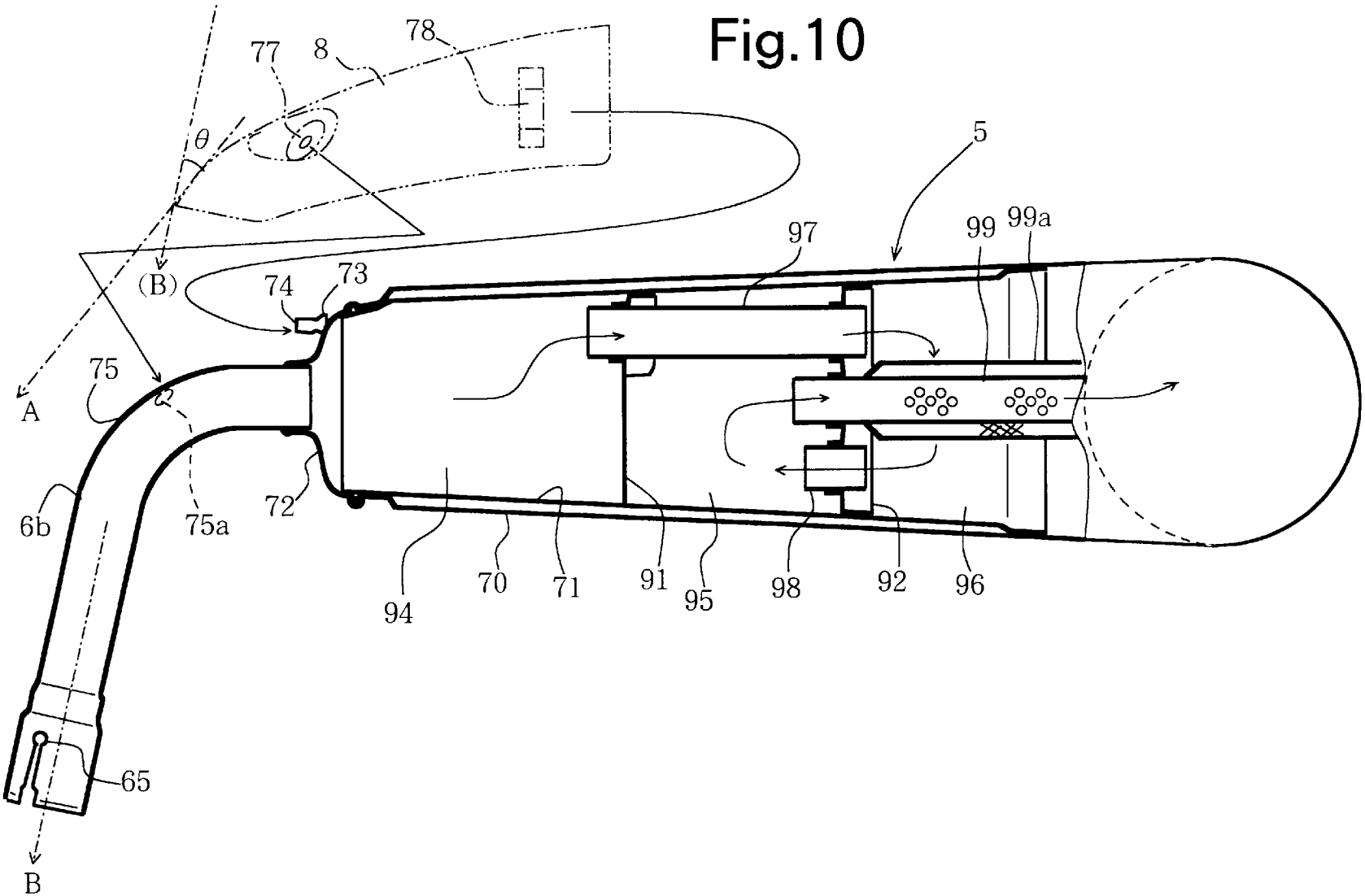
FIG. 10 is a horizontal sectional view of a right-hand part of the exhaust device.
Figure 11:
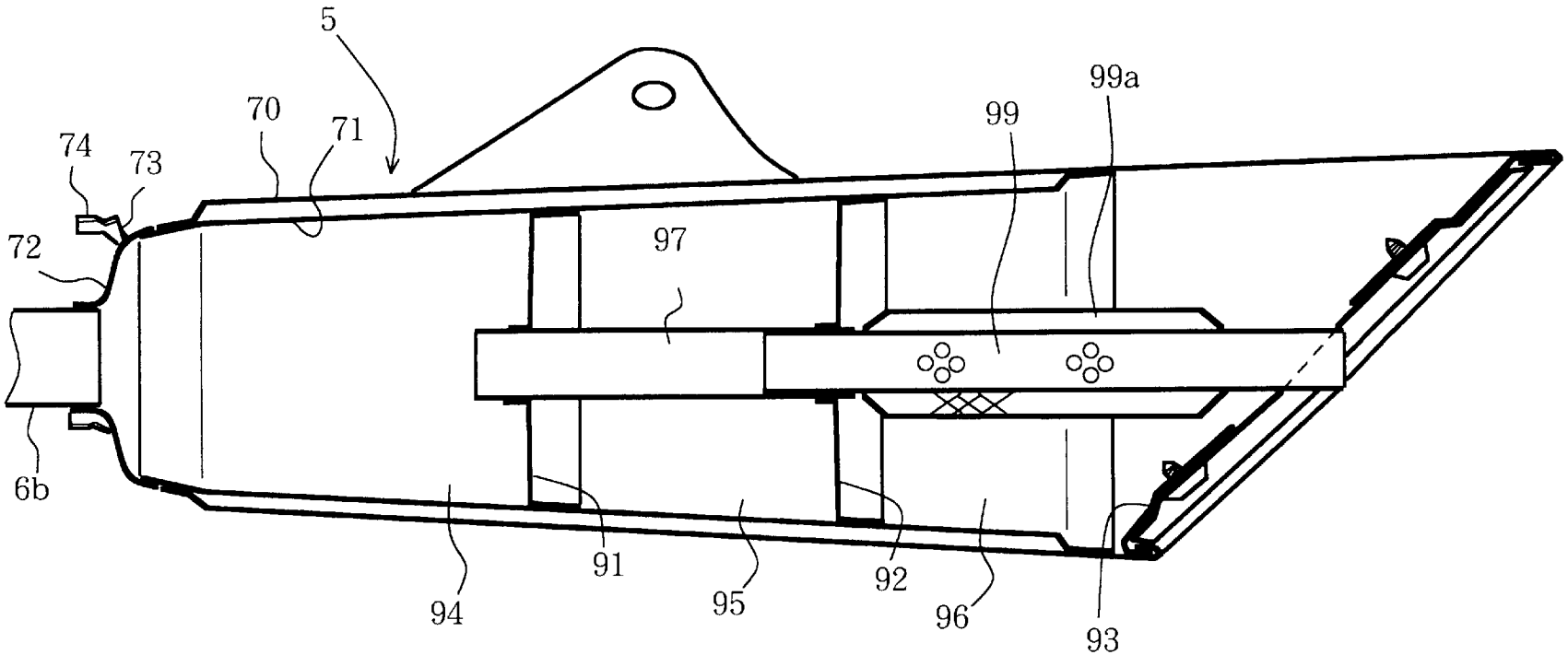
FIG. 11 is a vertical sectional view of the righthand part.

As apparent from FIG. 10, the right connecting pipe member 6*b* is bent at its rear end portion to extend rearward, and is connected to a front end portion of the second muffler 5. The second muffler 5 is similar in structure to the first muffler 4, that is, the second muffler 5 has a double-pipe structure composed of an outer wall 70 and an inner wall 71, and the inside space of the second muffler 5 is separated into a plurality of chambers. The outer surface of the outer wall 70 is generally plated.

Only the front end portion of the second muffler 5 is formed as a front cap 72 having a single-pipe structure. The front cap 72 is engaged with and welded to the front end of a body portion of the second muffler 5 having a double-pipe structure. The rear end portion of the right connecting pipe member 6*b* is connected to the front cap 72. A bracket 73 having two hooks 74 is welded to the outer surface of the front cap 72. The hooks 74 are raised from the outer surface of the front cap 72 and extend frontward.

Figure 12:
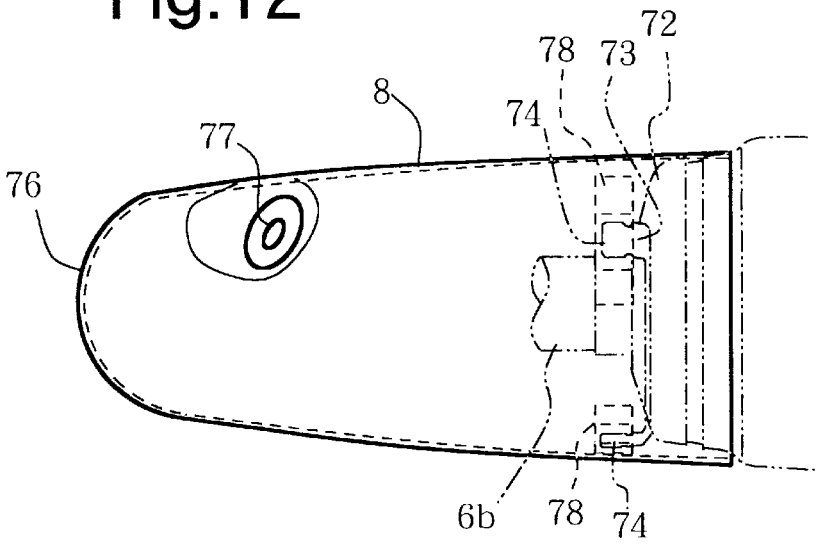
FIG. 12 is a side view of a second cover.
Figure 13:
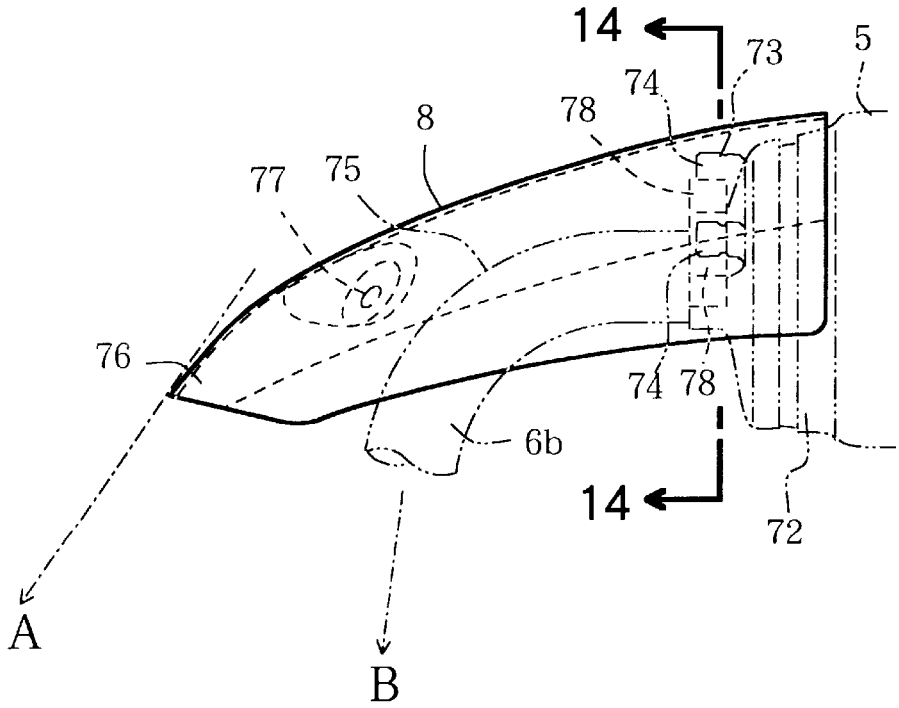
FIG. 13 is a top plan view of the second cover.
Figure 14:
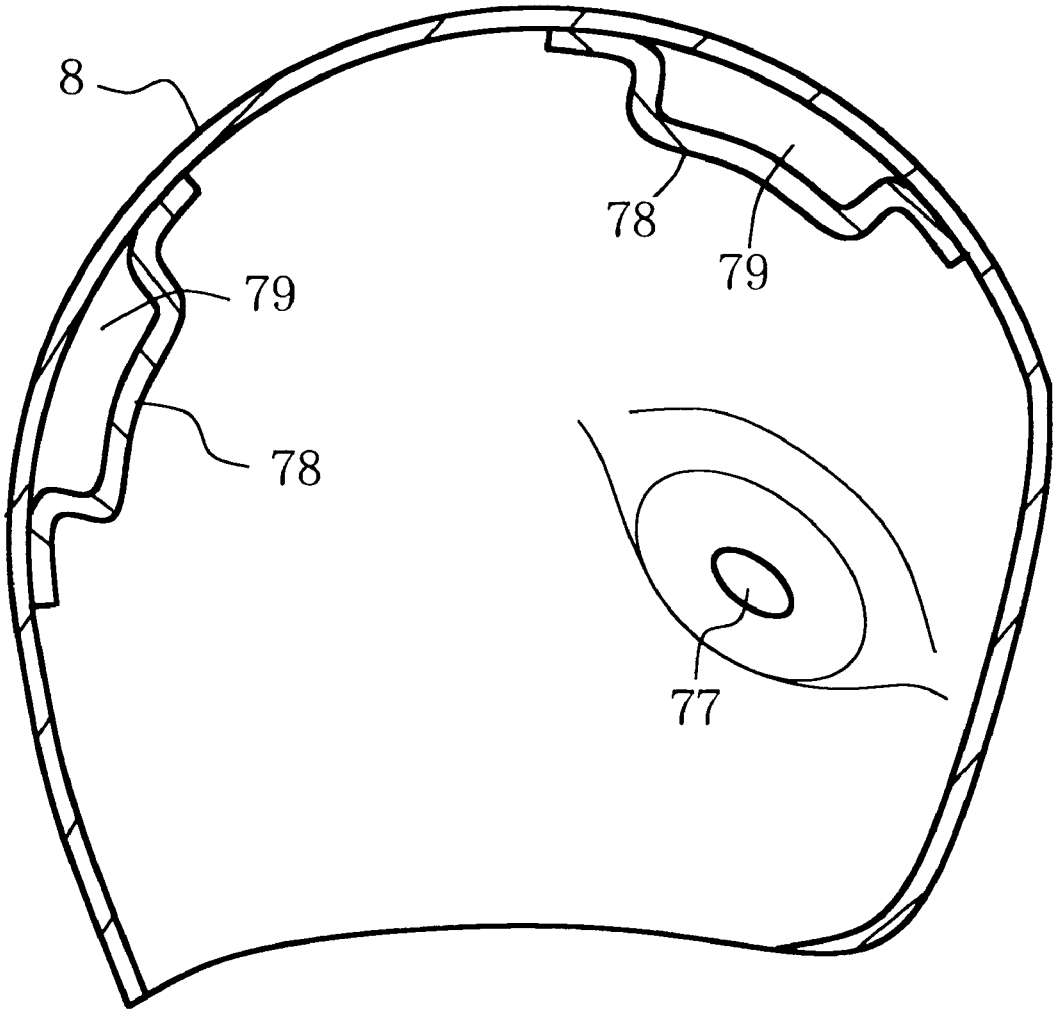
FIG. 14 is an enlarged cross section taken along the line 14—14 in FIG. 13.

As apparent from FIGS. 12 to 14, the second cover 8 has a structure substantially similar to that of the first cover 7, and the outer surface of the second cover 8 is also generally plated.

As apparent from FIG. 13, the second cover 8 is curved in such a manner that it forms a curved line extending from the front cap 72 substantially along a bent portion 75 of the right connecting pipe member 6b, and a front end portion 76 of the second cover 8 is directed toward the center of the vehicle body. That is, a phantom line A showing a continuous frontward extension from the front end portion 76 of the second cover 8 is directed toward the engine 1 located at the laterally central position of the vehicle body (see also FIG. 1).

As apparent from FIG. 10, the phantom line A forms an angle θ with respect t o the axis B of the right connecting pipe member 6*b*. The farther the phantom line A extends frontward from the front end portion 76 of the second cover 8, the larger the distance between the phantom line A and the axis B becomes. The axis B of the right connecting pipe member 6*b* is identical with the axis of the connecting pipe 6.

A through hole 77 is formed at a front portion of the second cover 8. As shown in FIG. 14, two stays 78 are mounted on the inner surface of the second cover 8 at its rear portion, so as to form two tunnel-like holes 79 for respectively engaging the two hooks 74.

The structure of the first and second mufflers 4 and 5 will now be described in brief. The first muffler 4 is connected at its open front end of the branch and joint member 3, and the inside space of the first muffler 4 is separated into first, second, and third extension chambers 84, 85, and 86 by means of first and second separators 81 and a tail cap 83.

The first expansion chamber 84 and the third expansion chamber 86 communicate with each other through a first communication pipe 87. The third expansion chamber 86 and the second expansion chamber 85 communicate with each other through a second communication pipe 88. The second expansion chamber 85 and the atmosphere communicate with each other through a third communication pipe 89.

The branch and joint member 3 is provided with a separator 80 located behind the side connection openings 63. As apparent from an enlarged view in FIG. 8, the separator 80 has a central hole 80*a* for passing the exhaust pipe 2 and a plurality of openings 80*b* formed around the central hole 80*a*. A part of exhaust gas discharged from the exhaust pipe 2 into the first expansion chamber 84 is allowed to pass through the openings 80*b* of the separator 80 and flow through the side connection openings 63 toward the second muffler S as shown by an arrow P in FIG. 8.

Similarly, the inside space of the second muffler 5 is separated into first, second, and third expansion chamber 94, 95, and 96 by means of first and second separators 91 and 92 and a tail cap 93.

The first expansion chamber 94 and the third expansion chamber 96 communicate with each other through a first communication pipe 97. The third expansion chamber 96 and the second chamber 95 communicate with each other through a second communication pipe 98. The second expansion chamber 95 and the atmosphere communicate with each other through a third communication pipe 99.

The operation of this preferred embodiment will now be described. In mounting the first cover 7, it is first placed on the outer side surface of the branch and joint member 3 and next moved rearward to make engagement of the hooks 62 with the holes 69*a* of the stays 69 mounted on the inner surface of the first cover 7 as shown in FIGS. 6 and 7.

Thereafter, the hole 68 formed at the front end portion of the first cover 7 is aligned with the nut portion 60 formed at the rear portion of the exhaust pipe 2, and a bolt (not shown) is engaged with the nut portion 60 through the hole 68, thereby securing the first cover 7 to the exhaust pipe 2 and the branch and joint member 3. Thus, the first cover 7 is mounted on the branch and joint member 3 so as to cover the outer side surface of the branch and joint member 3, thereby concealing it from side view. Furthermore, the first cover 7 looks as if it continues to the rear end portion of the exhaust pipe 2 and the front end portion of the first muffler 4.

In mounting the second cover 8, it is first placed on the outer side surface of the bent portion 75 of the right connecting pipe member 6*b* and next moved rearward to make engagement of the hooks 74 with the holes 79 of the stays 78 as shown in FIGS. 10 to 14. The hole 77 formed at the front end portion of the second cover 8 is aligned with a nut portion 75*a* (see FIG. 10) formed at the bent portion 75, and a bolt (not shown) is engaged with the nut portion 75*a* through the hole 77, thereby securing the second cover 8 to the right connecting pipe member 6*b* and the front cap 72.

Accordingly, the second cover 8 is so mounted as to cover the outer side surface of at least the bent portion 75 of the right connecting pipe member 6b and the front cap 72. Thus, a portion of these single-pipe structural components appearing outward of the vehicle body is concealed from side view.

As a result, all the externally visible portions of the exhaust device on the right and left sides of the vehicle body look as if they are substantially uniformly plated. Accordingly, even if the single-pipe structural components (3, 6, 72) are discolored by exhaust heat, the appearance of the vehicle body is not damaged.

Furthermore, the first cover 7 plated looks as if it continues to the exhaust pipe 2 and the first muffler 4 both plated, and the second cover 8 plated similarly looks as if it continues to the second muffler 5 plated. Accordingly, the first and second covers 7 and 8 readily look like continuous portions of the exhaust device rather than mere separate covers that may look as if they are raised from their surrounding parts. Thus, the appearance of the exhaust device as a whole can be made into a condition such that it is substantially uniformly plated without any discoloration due to exhaust heat.

Accordingly, all of the branch and joint member 3, the connecting pipe 6, and the front cap 72 concealed by the first and second covers 7 and 8 can be formed as a singlepipe structural components without plating. By connecting the rear end portion of the exhaust pipe 2, the first muffler 4, and the second muffler 5 each having a double-pipe structure through the above single-pipe structural components, the connection structure of each connecting component can be simplified and the exhaust device can be easily manufactured.

Although the single-cylinder engine 1 is mounted on the motorcycle, the pair of mufflers 4 and 5 can be provided on the opposite sides of the vehicle body without damage to the appearance, and it is possible to provide an exhaust device having a good look as a whole and easy to manufacture.

Further, the front end portion of the second cover 8 is so curved as to be directed toward the engine 1 located at the laterally central position of the vehicle body, and the phantom line A continuously extending frontward from the front end portion of the second cover 8 is positioned before the axis B of the connecting pipe 6 (see FIGS. 10 and 13) . Accordingly, the second muffler 5 looks as if it is directly connected to a virtual exhaust pipe 9 (see FIG. 1) which is connected to the engine 1.

Further, the second cover 8 readily looks as if it is a part of the second muffler 5 and the presence itself of the second cover 8 is not visually felt, thereby providing natural feeling to the exhaust device as a whole and further improving the appearance.

INDUSTRIAL APPLICABILITY

As described above, the exhaust device for vehicles according to the present invention is available to the exhaust system of the motorcycle including an exhaust pipe extending from the engine toward the center portion or one side of the vehicle body and the mufflers provided on the right and left side of the vehicle body connecting to the rear end portion of the exhaust pipe. It is especially favorable for the single cylinder type engine, and is further applicable also for the various types of the engine having tandem cylinders, V-type plural cylinders and the like.

What is claimed is:

1. In an exhaust device for a vehicle including a single-cylinder engine, an exhaust pipe (2) extending from said single-cylinder engine toward one side of a rear portion of a vehicle body, a first muffler (4) connected to a rear end portion of said exhaust pipe (2) and provided on one side of said vehicle body, a second muffler (5) provided on the other side of said vehicle body opposite to said first muffler (4), and a connecting pipe for connecting said second muffler and said exhaust pipe, said connecting pipe (6) extending laterally of said vehicle body, each of said exhaust pipe (2), said first muffler (4), and said second muffler (5) having a double-pipe structure with outside plating; the improvement wherein:

said rear end portion of said exhaust pipe is connected through a branch and joint member (3) having a single-pipe structure to a front end portion of said first muffler (4);

an end portion of said connecting pipe (6) having a single-pipe structure is connected to said branch and joint member (3);

an outer side surface of said branch and joint member (6) is covered with a first cover (7) plated; and an outer side surface of a connecting portion (3) between a front portion of said second muffler (5) and said connecting pipe (6) is covered with a second cover (8) plated.

2. An exhaust device for a vehicle according to claim 1, wherein a front end portion of said second cover (8) is curved toward the center of said vehicle body, and a phantom line continuously extending frontvard from said front end portion of said second cover (8) is positioned before the axis of said connecting pipe (6).

* * * * *